United States Patent [19]

Johnson

[11] 4,397,291

[45] Aug. 9, 1983

[54] MEANS FOR MOUNTING IGNITION CONTROL MODULES

[75] Inventor: Arthur D. Johnson, Muskego, Wis.

[73] Assignee: Wells Manufacturing Corporation, Fond du Lac, Wis.

[21] Appl. No.: 301,105

[22] Filed: Sep. 10, 1981

[51] Int. Cl.[3] ..... F02P 1/00

[52] U.S. Cl. ..... 123/640; 123/647; 123/479

[58] Field of Search ..... 123/640, 647, 479

[56] References Cited

U.S. PATENT DOCUMENTS

| | | | |
|---|---|---|---|
| 1,543,521 | 6/1925 | Ristau | 123/640 |
| 1,564,102 | 12/1925 | Nowosielski | 123/640 |
| 1,577,670 | 3/1926 | Woolson | 123/640 |
| 3,834,361 | 9/1974 | Keely | 123/479 |
| 4,000,729 | 1/1977 | Clark | 123/640 |
| 4,049,957 | 9/1977 | Kera | 123/479 |
| 4,207,851 | 6/1980 | Crisefi | 123/640 |

FOREIGN PATENT DOCUMENTS 2635889 2/1978 Fed. Rep. of Germany ..... 123/647

OTHER PUBLICATIONS

Crysler Service Manual, pp. 8–47, 1978.

*Primary Examiner*—Ronald B. Cox

[57] ABSTRACT

The invention includes an ignition control assembly including a first ignition control module adapted to be connected to the distributor and to control electrical operation of the distributor, and a redundant ignition control module including circuit means adapted to be connected to the distributor to control electrical operation of the distributor. The control modules are mounted in a location remote from the distributor. The mounting includes a heat sink for maintaining the control modules at relatively low temperatures. A switch and circuitry are also provided for alternatively providing an electrical connection between the first control module and the distributor and between the redundant control module and the distributor.

2 Claims, 3 Drawing Figures

MEANS FOR MOUNTING IGNITION CONTROL MODULES

FIELD OF THE INVENTION

The invention relates to ignition systems for vehicles and more particularly to ignition control modules used in controlling current supplied by an ignition coil to the distributor in an internal combustion engine and to means for mounting such ignition control modules in a vehicle.

BACKGROUND PRIOR ART

Internal combustion engines employed in modern vehicles commonly include control modules operably connected to the engine's distributor and for controlling the distribution of spark to the spark plugs. The ignition control modules comprise micro-computer circuits adapted to control engine timing, these circuits being incased in a thermoplastic block. More specifically, the micro-computer circuits are used in controlling the electrical current from the coil of the ignition system to the distributor and in controlling the variation of the ignition dwell in response to engine speed. For example, the control modules may provide for a 15° dwell at 700 rpm and 30° to 32° dwell at 2000 rpm.

It has been found that engine failure may often be attributed to failure of the control modules, and such failure occurrs particularly in engines operating under heavy loads such as in military vehicles or in emergency vehicles.

SUMMARY OF THE INVENTION

The present invention provides a means for mounting the control modules of an engine in a manner intended to reduce the rate of failure of the control modules. More particularly, the control modules are mounted in a location remote from the distributor and wherein the modules can be supported in an environment having a temperature lower than that which exists in the immediate vicinity of the engine block. The invention also provides a redundant ignition control module assembly and means for alternatively operatively connecting one control module or a second redundant control module to the engine ignition system whereby the redundant control module can be made operative in the event of failure of the first control module. Means are also provided by the invention for mounting the control modules such that heat being generated in the control module due to internal resistance of the circuitry in the control module is removed by a heat sink and dissipated.

More particularly, the invention includes an ignition control assembly for use in a vehicle having an engine including a distributor and wherein the ignition control assembly includes a first ignition control module including circuit means adapted to be connected to the distributor and for controlling electrical operation of the distributor, and a redundant ignition control module including circuit means adapted to be connected to the distributor and for controlling electrical operation of the distributor. The ignition control assembly also includes means for mounting the first control module and the redundant control module in a location remote from the distributor. The control assembly also includes means for alternatively providing an electrical connection between the first control module and the distributor and between the redundant control module and the distributor.

In one embodiment of the invention the means for mounting includes means for providing a heat sink supporting the modules and for removing heat from the control modules and dissipating the heat to the surrounding atmosphere.

In one embodiment of the invention the means for mounting includes a metal plate having opposite sides, the modules being supported on one side, and the other side of the plate supporting means for dissipating heat, the means for dissipating heat including a plurality of parallel spaced apart metal vanes.

In one embodiment of the invention the means for alternatively providing an electrical connection includes switch means for alternatively connecting the first control module and the redundant control module to the distributor.

In one embodiment, the invention further includes means connected to the first ignition control module for indicating when the first ignition control moduel is operative and means connected to the redundant control module and indicating when the redundant control module is operating.

Various other features and advantages of the invention will be apparent from the following description of a preferred embodiment, from the claims, and from the drawings.

Figure 1:
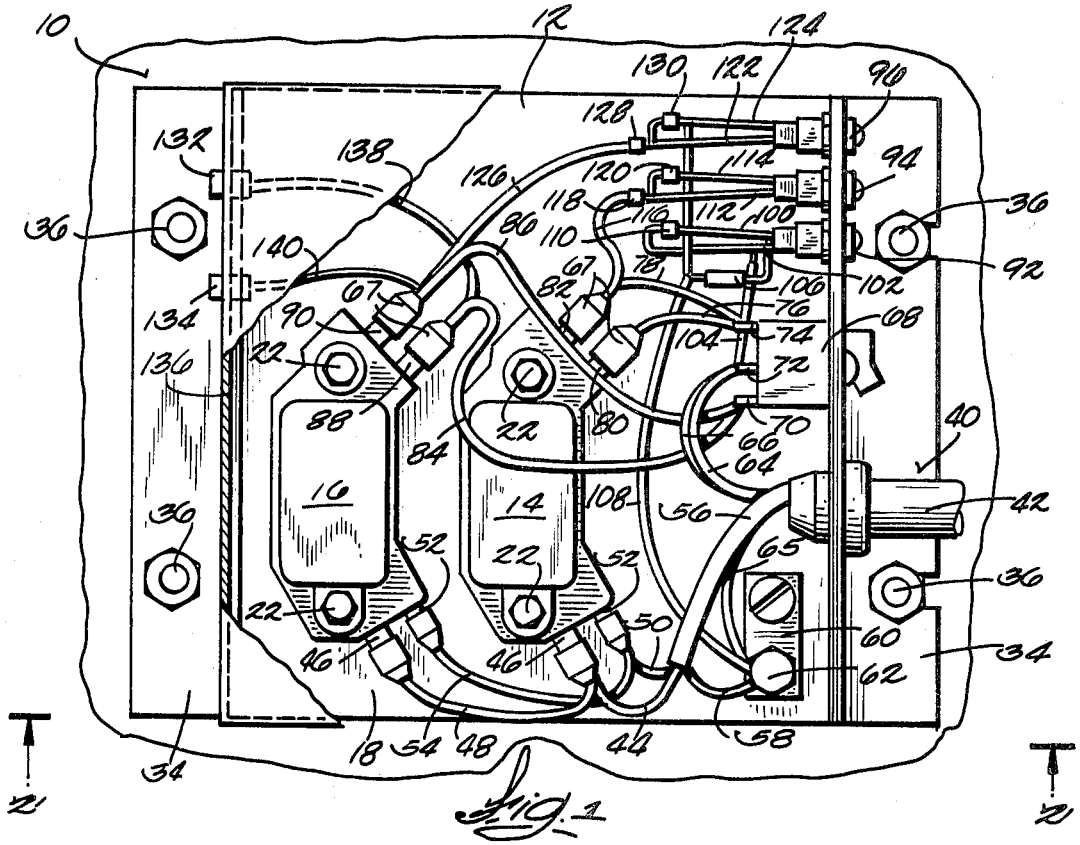
FIG. 1 is a plan view of a redundant ignition control module assembly embodying the invention and with portions broken away in the interest of clarity.

Before describing at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is an ignition control module assembly 10 embodying the invention and adapted for use in vehicles having an internal combustion engine, and wherein the engine includes an ignition coil and a distributor adapted to transmit electrical current from the ignition coil to spark plugs in a predetermined sequence. In one form of the invention, the ignition control module assembly 10 includes a housing or mounting block 12 adapted to support a first ignition control module 14 and a redundant ignition control module 16. The ignition control modules 14 and 16 are identical and have a conventional construction. As is well known in the art, ignition control modules such as those illustrated in FIG. 1 comprise micro-computer circuits which are functional to control the electrical impulses from the ignition coil to the distributor.

Figure 2:
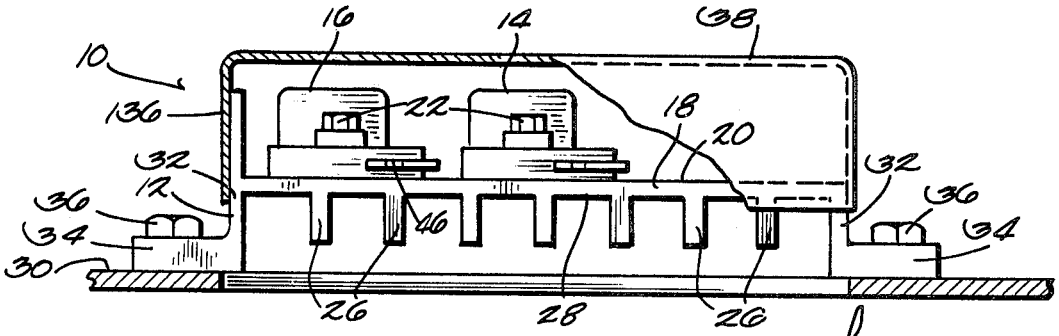
FIG. 2 is a cross section view taken along line 2—2 in FIG. 1.
Figure 3:
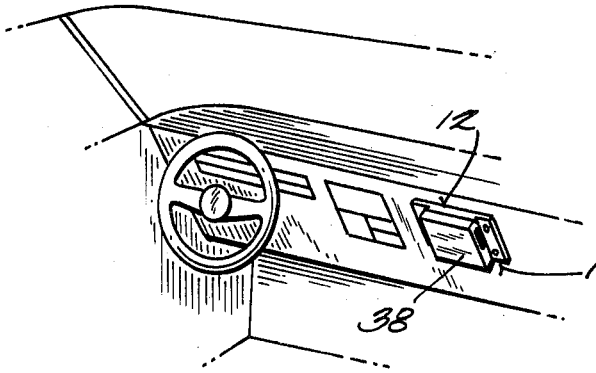
FIG. 3 is a perspective view illustrating a control module assembly shown in FIG. 1 mounted on a dashboard of a vehicle.

In the illustrated construction, the housing or mounting block 12 is comprised of a metal block, such as cast steel or aluminum, and includes a planar floor or plate 18 having a mounting surface 20 (FIG. 2). The ignition control modules 14 and 16 are positioned on the mounting surface 20 in mutually spaced apart relation and are secured thereto by mounting bolts 22 which extend through the control modules 14 and 16 and into threaded bores in the mounting plate 18. As will be described more particularly hereinafter, the housing or mounting block 12 may be mounted either in the engine compartment of the vehicle or on the vehicle dashboard, as illustrated in FIG. 3, and in a position remote from the engine block such that the heat of the engine does not result in undue heating of the control modules 14 and 16.

The housing or mounting block 12 is also constructed so as to maintain the control modules 14 and 16 at reduced temperatures i.e. temperatures near the ambient temperature of the air surrounding the housing. While the mounting block 12 may have other constructions, in the illustrated arrangement this is provided by a plurality of vanes 26 integral with the mounting plate 18 and extending from its rear surface 28 or its surface opposite that surface 20 supporting the ignition control modules 14 and 16. The vanes 26 are mutually parallel and spaced apart and function to disburse any heat in the housing to the ambient air.

In the particular embodiment illustrated, the housing 12 also includes means for supporting the mounting plate 18 in spaced relation from the supporting surface 30 to which the mounting block 12 is attached such that air can move past the vanes 26 to remove heat from the mounting block 12. This means for supporting includes a pair of legs 32 which extend downwardly from the sides of the mounting plate 18, the legs 32 including flanges 34. Bolts 36 extend through bores in the flanges 34 to thereby secure the mounting block 12 to any suitable surface 30.

In the illustrated construction, the housing 12 also includes a rectangular sheet metal cover 38, the sheet metal cover being constructed in such a manner as to snap over the mounting block and to provide a means for shielding the ignition control modules 14 and 16.

Another feature of the invention is that the housing 12 for the control modules is mounted remotely from the engine to thereby reduce the ambient temperature of the environment surrounding the modules. Ignition control modules such as control modules 14 and 16 are commonly mounted in the engine distributor, beneath the distributor cap, and adjacent to the distributor rotor shaft. The rotor shaft commonly extends downwardly into the engine oil reservoir and is thereby heated by the oil. The positioning of the distributor closely adjacent the engine block also subjects the control module to heat. Failure of the control module can result from this heat, particularly in vehicles such as military vehicles or emergency vehicles where the engines are subject to heavy loads. When these engines are operating under such loads, the heat of the engine oil heats the rotor shaft of the distributor and this heat is transmitted to the control module. The operation of the engine at high speeds also results in increased current flow through the circuits of the control module and the internal resistance of these circuits functions to increase the temperature of the module. It has been found that if the temperature of the module reaches 175° to 225° F., the module may fail or otherwise become inoperative.

By removing the control module from the immediate vicinity of the engine block and by providing means for removing heat from the module produced by the internal electrical resistance of the circuits of the module, the module can be maintained at a temperature below that at which the module will cease to function.

In the illustrated embodiment of the invention, the housing 12 is shown as being mounted on the dashboard of a vehicle and is thereby removed from the heat of the engine. It should be understood, however, that the housing 12 can be mounted in any position where it can be conveniently attached to the vehicle and where it will be removed from the heat of the engine. For example, the control module assembly 10 could be mounted in any convenient location in the engine compartment such as on the fire wall.

Means are also provided for operably connecting selective ones of the control modules 14 and 16 to the distributor. While various means of connecting could be envision, in the illustrated construction, this means comprises a cable 40 including a braided metal mesh sheath 42 housing a number of wires which are operable to connect a selected one of the ignition control modules 14 and 16 to the distributor. The braided metal mesh sheath 42 functions to provide IFR control for the wires housed in the metal sheath. More particularly, the cable includes a wire 44 connected in series to the terminals 46 of each of the control modules 14 and 16. The wire 44 is connected to the terminal 46 of the secondary or redundant control module 16 by a wire 48. The cable 40 also includes a second wire 50 which is connected in series to the terminals 52 of each of the control modules 14 and 16. The wire 50 is connected to the terminal 52 of the module 16 by a wire 54. The opposite ends of the wires 44 and 50 are connected to the pickup coil of the engine ignition system. The wires 44 and 50 are housed within an insulating sheath 56, that insulating sheath 56 also surrounding a bare ground wire 58 connected to a ground lug 60 of the housing 12. The ground wire 58 is connected to the ground lug 60 by a bolt 62.

The shielded cable also includes a ground wire 65 connected by means of bolt 62 to the ground lug 60 and to the mounting block or housing 12.

The shielded cable 40 also includes wires 64 and 66 connected to a double pole double throw switch 68. The opposite ends of the wires 64 and 66 are adapted to be connected to the distributor wiring harness of the engines ignition system (not shown) and routed to the ignition coil. The double pole double throw switch 68 provides a means for alternately connecting the wires 64 and 66 to either the first control module 14 or the redundant control module 16. As is conventional, the double pole double throw switch 68 includes three pairs of terminals 70, 72 and 74. The wires 64 and 66 are connected to respective ones of the pair of terminals 72. Respective ones of a second pair of terminals 74 of the switch 68 are connected by means of wires 76 and 78 to respective terminals 80 and 82 of the first ignition control module 14. The switch 68 further includes a third pair of terminals 70, and respective ones of these terminals 70 are connected by means of wires 84 and 86 to terminals 88 and 90, respectively, of the redundant ignition control module 16. When the switch 68 is in the position illustrated in FIG. 1, the switch 68 will provide an electrical connection between the wires 64 and 66 and the terminals 80 and 82 of the first control module 14 through the wires 76 and 78. When the switch 68 is moved to the alternate position, the wires 64 and 66 will be in electrical connection with terminals 88 and 90 of the redundant ignition control module 16.

While in the illustrated arrangement, a switch 68 is provided for selectively connecting the wires 64 and 66 to a selected one of the ignition control modules 14 and 16, in other arrangements the ends of the wires 64 and 66 could be connected by clips, such as clips 67, directly to the terminals of one module or the other. In the event of failure of one of the modules, the clips 67 could be removed manually from the terminals of that module and placed on the terminals of the other module.

Additionally, while in the illustrated construction the switch 68 is shown as being mounted on the housing 12, in the event the housing 12 is mounted in the engine compartment, the switch 68 could be mounted independently of the housing on the vehicle control panel.

Means are also provided in the particular embodiment illustrated for indicating the operability of the control assembly and of the individual control modules 14 and 16. This means includes a series of three light emitting diodes 92, 94 and 96, the diode 92 being arranged so as to indicate that electrical current is going from the vehicle battery or electrical system to the modules. The means for indicating operability also includes a second pair of light emitting diodes 94 and 96 operably connected to respective ones of the modules 14 and 16 and functional to indicate the operability of those control modules.

In operation, the light emitting diodes are arranged such that if the light emitting diode 92 is lit, the operator will know that current is being supplied to the selected module. If the selected module 14 or 16 is functional, the respective light emitting diode 94 and 96 associated with that module will be lit. If it is not lit, the operator can then throw the switch 68 to operably connect the other control module to the ignition system and to cause its associated light emitting diode to be lit. As an example of the operation of this arrangement, if during cranking of the invention, the light 92 is lit but neither of the lights 94 or 96 are lit, the operator will know that one of the modules is not operative. He can then move the switch 68 to its alternate position to thereby actuate the other module whereupon the light emitting diode associated with that module will be lit.

Referring now more specifically to the circuitry of the light emitting diodes, the light emitting diode 92 includes a pair of terminals 100 and 102. The terminal 102 of the light emitting diode 92 is connected to one of the terminals 72 of the switch by means of a wire 104. The other terminal 100 of the light emitting diode 92 is connected through a 680 ohm, $\frac{1}{4}$ watt resistor 106 to a wire 108 in turn connected to the ground lug 60. The terminals 100 and 102 of the light emitting diode 92 are also bridged by a diode 110. In operation, when current is being supplied to the switch 68, the light emitting diode 92 will be lit.

The light emitting diode 94 similarly includes terminals 112 and 114, the terminal 112 being connected by means of a wire 116 and through a zenar diode 118 to the terminal 82 of the first control module 14. The other terminal 114 of the light emitting diode 94 is connected to the ground wire 108 and is also connected to the output of the zenar diode 118 through a second diode 120. The third light emitting diode 96 also includes a pair of terminals 112 and 124, the terminal 122 being connected to the terminal 90 of the redundant ignition control module 16 through a wire 126 and through a zenar diode 128. The other terminal 124 of the light emitting diode 96 is connected to the ground wire 108 and is also connected to the output of the zenar diode 128 through a diode 130.

Also included is means for providing connection of a conventional test apparatus to the control module assembly. Conventional test apparatus is available for testing the operation of control modules, for testing the ignition coil, and for testing the condensor and other ignition components. In using such conventional test apparatus, the test normally requires the removal of the distributor cap and the connection of leads of the test apparatus to the terminals such as terminals 88 and 90 of the ignition control module in the distributor. In the illustrated construction, an improved means is provided for testing of the ignition components. This includes a pair of jacks 132 and 134 which are supported in spaced relation in bores in a side wall 136 of the housing 12, the jack 132 being connected by a wire 138 to the terminal 88 of the redundant control module 16 and the other jack 134 being connected by a wire 140 to the terminal 90 of the redundant control module 16.

While the control module assembly described above has been referred to as particularly useful in military vehicles and emergency vehicles, the present invention is also useful in internal combustion engines used in marine applications as well as in conventional trucks, buses or automobiles.

Various features of the invention are set forth in the following claims.

I claim:

1. An ignition control assembly for use in a vehicle having an engine, the engine including a distributor, the ignition control assembly comprising:

a first ignition control module including circuit means adapted to be selectively connected to the distributor for controlling electrical operation of the distributor, a redundant ignition control module including circuit means adapted to be selectively connected to the distributor for controlling electrical operation of the distributor, means for mounting said first control module and said redundant control module in a location remote from said distributor, means for alternatively providing an electrical connection between said first control module and the distributor and between said redundant control module and the distributor, wherein said means for mounting includes a metal plate having opposite sides, one of said sides including a planar surface, said modules being supported by said surface and the other side of said plate including means for dissipating heat, said means for dissipating heat including a plurality of parallel spaced apart vanes extending from said other side.

2. In a vehicle having an internal combustion engine including spark plugs, a distributor adapted to transmit electrical current from an ignition coil to the spark plugs, an ignition control assembly comprising:

a first ignition control module including circuit means for controlling electrical current from said ignition coil to said distributor, a redundant ignition control module including circuit means for controlling electrical current from said ignition coil to said distributor, means for mounting said first ignition control module and said second ignition control module in a location remote from said distributor, and means for alternatively providing an electrical connection between said first control module and the distributor and said redundant control module and the distributor, wherein said means for mounting includes a metal plate having opposite sides, one of said sides including a planar surface, said modules being supported by said surface and the other side of said plate including means for dissipating heat, said means for dissipating heat including a plurality of parallel spaced apart vanes extending from said other side.

* * * * *